US008113869B2

(12) United States Patent
Su et al.

(10) Patent No.: US 8,113,869 B2
(45) Date of Patent: Feb. 14, 2012

(54) CABLE CONNECTOR ASSEMBLY WITH A FRONT SHELL

(75) Inventors: Ping-Sheng Su, Tu-Cheng (TW); Jun Chen, Kunshan (CN); Qing Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/968,301

(22) Filed: Dec. 15, 2010

(65) Prior Publication Data

US 2011/0143576 A1 Jun. 16, 2011

(30) Foreign Application Priority Data

Dec. 15, 2009 (CN) ..... 2009 2 0317446

(51) Int. Cl.
*H01R 13/58* (2006.01)

(52) U.S. Cl. ..... 439/455; 439/465

(58) Field of Classification Search ..... 439/455, 439/465

See application file for complete search history.

(56) References Cited

U.S. PATENT DOCUMENTS

| | | | | |
|---|---|---|---|---|
| 6,984,151 | B2 * | 1/2006 | Wu | 439/607.56 |
| 7,497,738 | B2 * | 3/2009 | Kuo | 439/638 |
| 7,883,375 | B2 * | 2/2011 | Li et al. | 439/620.24 |
| 8,007,317 | B2 * | 8/2011 | Su et al. | 439/607.46 |

FOREIGN PATENT DOCUMENTS

CN 2390286 Y 8/2000

* cited by examiner

*Primary Examiner* — Renee Luebke
*Assistant Examiner* — Larisa Tsukerman
(74) *Attorney, Agent, or Firm* — Wei Te Chung; Andrew C. Cheng; Ming Chieh Chang

(57) ABSTRACT

A cable connector assembly (100) in accordance with the present invention comprises an insulative housing (1) and a plurality of contacts (2) received therein, a cable (5) connected with the contacts (2), a strain relief portion (50) molded on the cable (5), the strain relief portion (5) having a extruding portion (52) on the front end thereof and a retaining portion (51) behind the extruding portion (52), a plurality of retaining blocks arranged between the extruding portion (52) and the retaining portion (51), a cover (8) enclosing the aforementioned components, the cover (8) comprising an upper cover (81) and a lower cover (82), a back surface of the upper cover (81) and the lower cover (82) defining a arc-shaped cutout, the retaining portion (51) is mounted in the front of the arc-shaped cutout and the retaining block is locked in the arc-shaped cutout.

11 Claims, 6 Drawing Sheets

CABLE CONNECTOR ASSEMBLY WITH A FRONT SHELL

BACKGROUND OF THE INVENTION

1. Field of the Invention

The present invention generally relates to a cable connector assembly, and more particularly to a cable connector assembly used for locking the strain relief thereof.

2. Description of Related Art

Nowadays, cable connector assemblies contain a strain relief molding outside the cable, and then put the cable molding with the strain relief in the shell of the cable assembly, CN patent No. 2390286Y issued on Aug. 2, 2000 to Lai discloses a cable connector assembly, the cable connector assembly comprises a method of installing the strain relief in the space of the shell, because of the joint force between the strain relief and the shell is small may occure the strain relief remove in the shell and the effect the electrical transmission.

Correspondingly, it is desired to have a cable connector assembly with improved jointing force between the strain relief and the shell.

BRIEF SUMMARY OF THE INVENTION

Accordingly, an object of the present invention is to provide a cable connector assembly may enforce the joint force between the strain relief and the shell.

In order to achieve the above-mentioned object, a cable connector assembly in accordance with the present invention comprises an insulative housing and a plurality of contacts received therein, a cable connected with the contacts, a strain relief portion molded on the cable, the strain relief portion having a extruding portion on the front end thereof and a retaining portion behind the extruding portion, a plurality of retaining blocks arranged between the extruding portion and the retaining portion, a cover enclosing the aforementioned components, the cover comprises a upper cover and a lower cover, a surface of the upper cover and the lower cover defining a arc-shaped cutout, the retaining portion is mounted in the front of the arc-shaped cutout and the retaining block is locked in the arc-shaped cutout.

Other objects, advantages and novel features of the invention will become more apparent from the following detailed description of the present embodiment when taken in conjunction with the accompanying drawings.

DETAILED DESCRIPTION OF THE INVENTION

Figure 1:
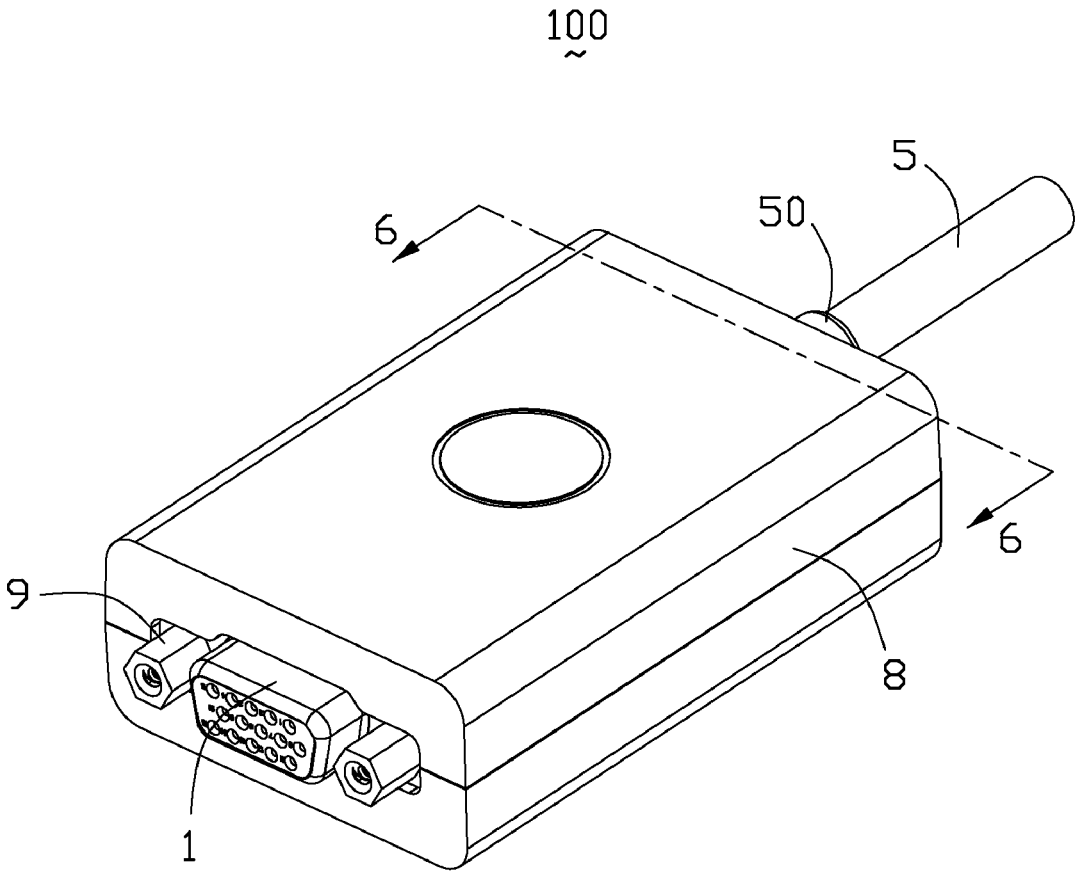
FIG. 1 is an assembled, perspective view of a cable assembly of the present invention.

Reference will now be made to the drawing figures to describe the present invention in detail.

Figure 2:
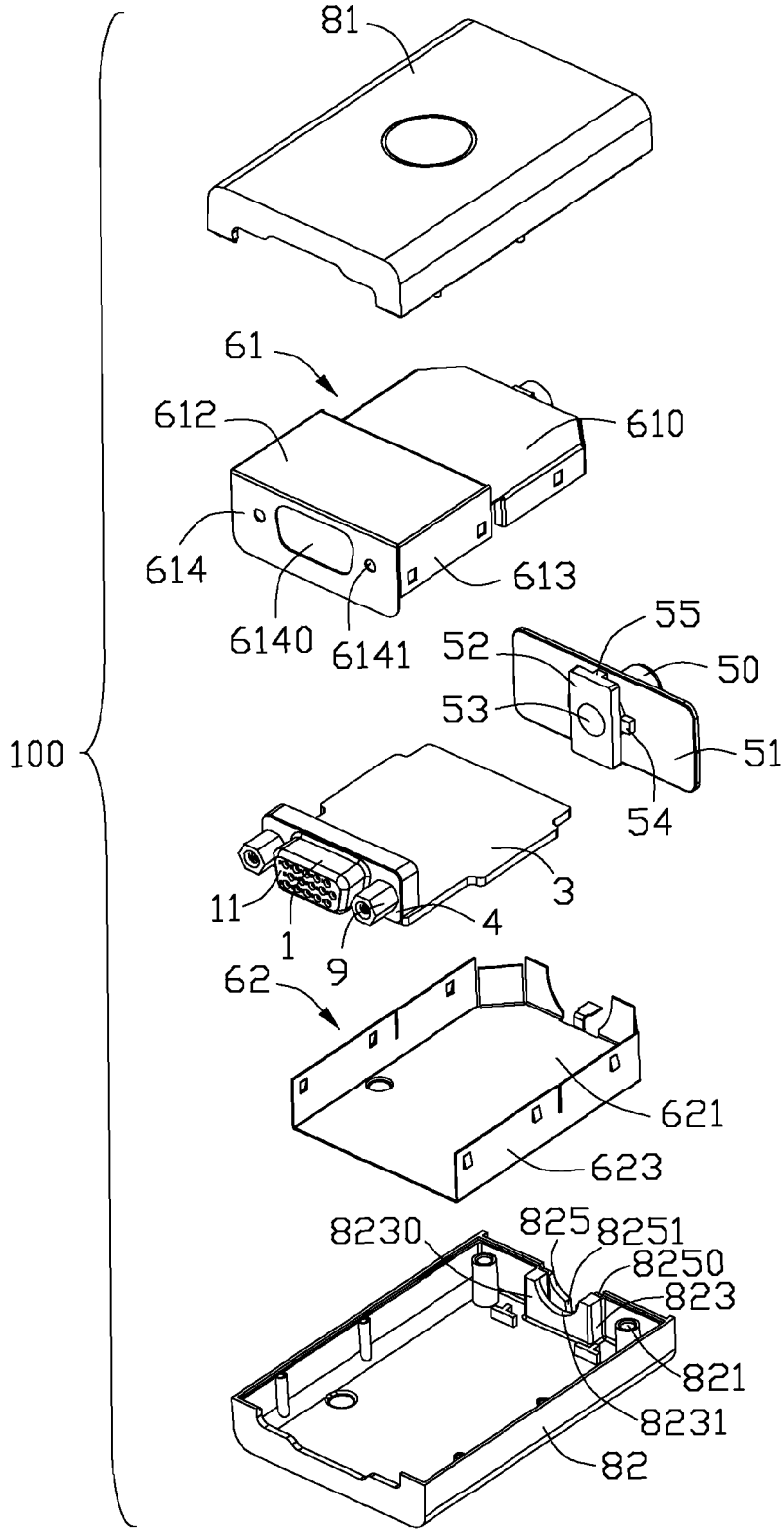
FIG. 2 is an exploded, perspective view of the cable connector assembly.
Figure 3:
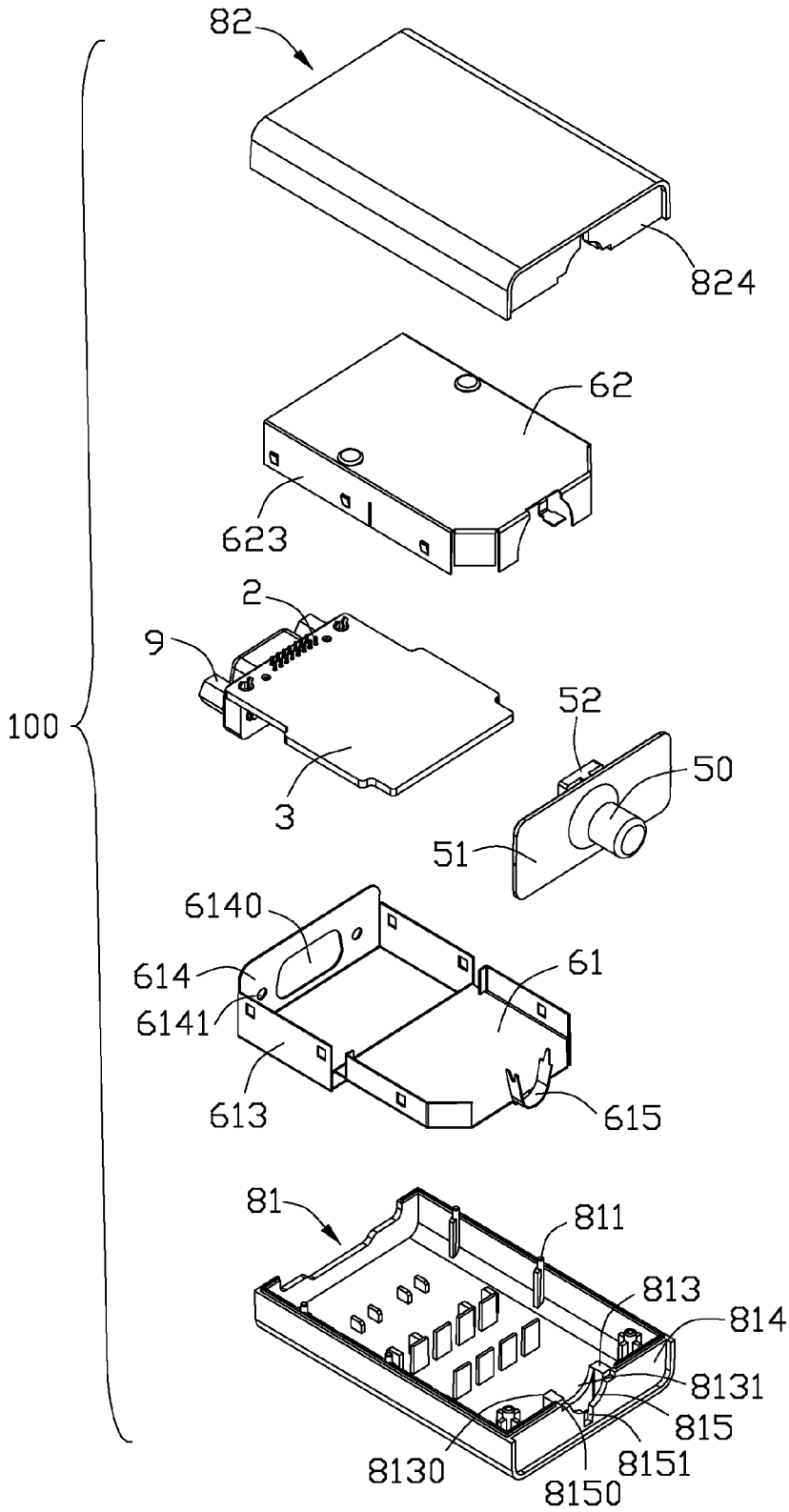
FIG. 3 is similar to FIG. 2, but viewed from another aspect.
Figure 4:
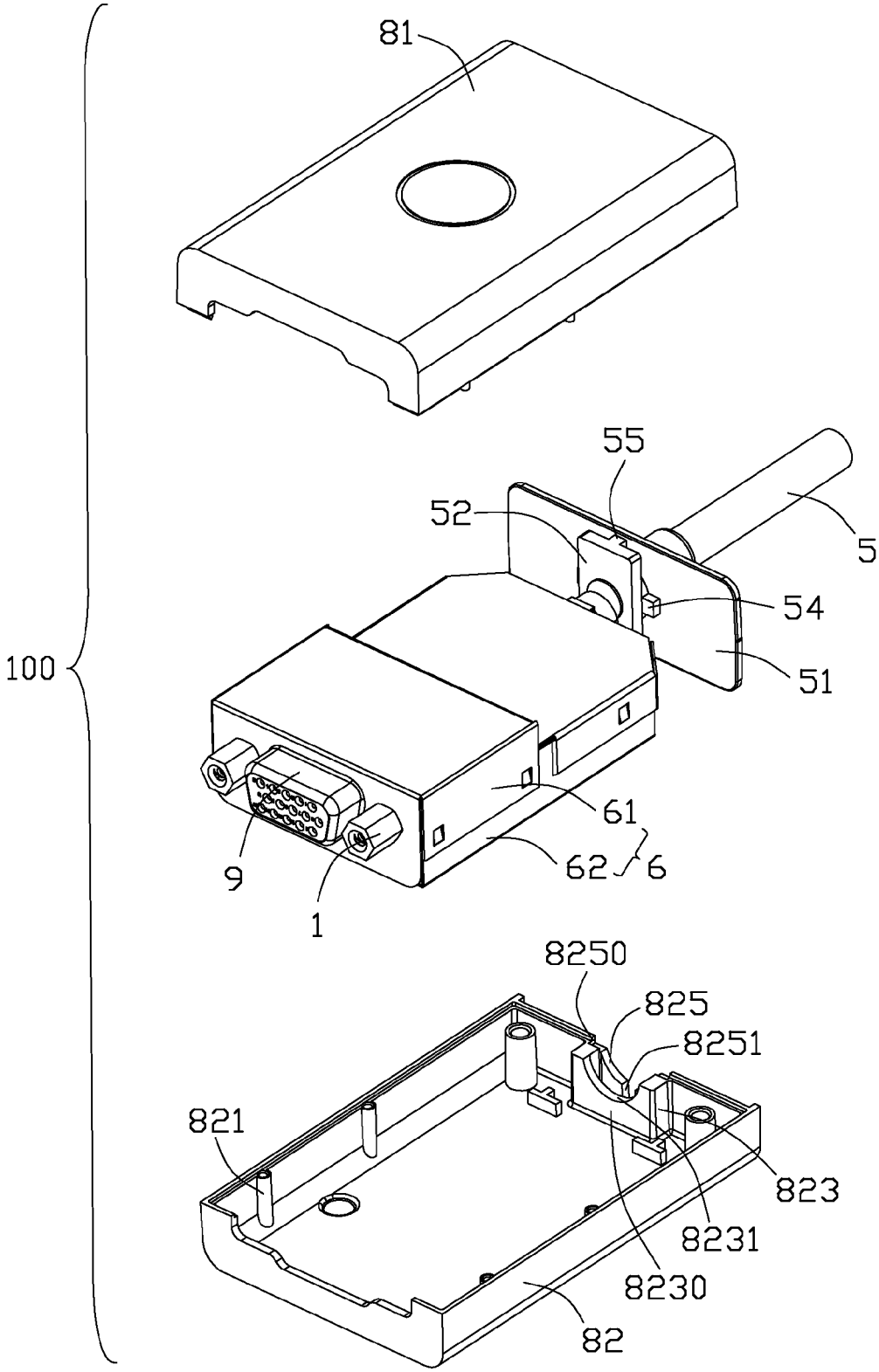
FIG. 4 is a partially exploded, perspective view of the cable connector assembly shown in FIG. 2.
Figure 5:
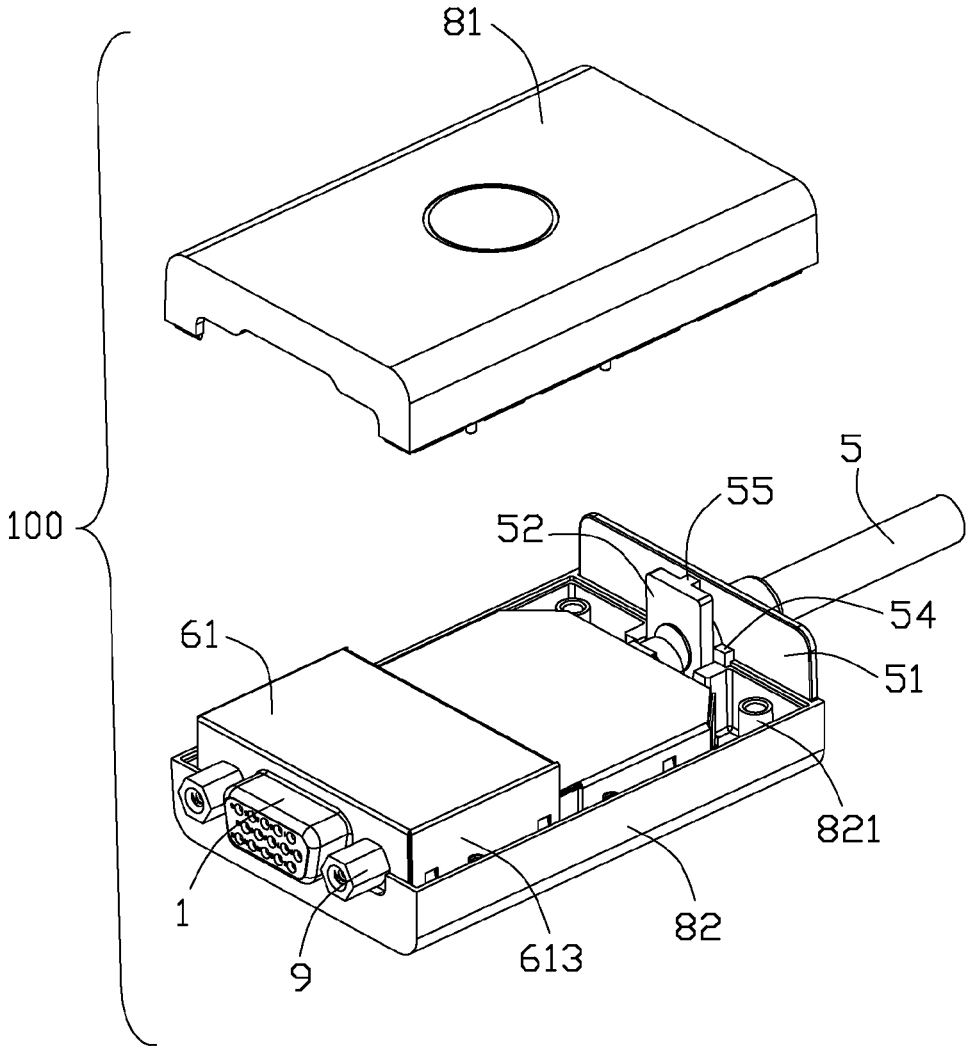
FIG. 5 is another partially exploded, perspective view of the cable connector assembly shown in FIG. 2.
Figure 6:
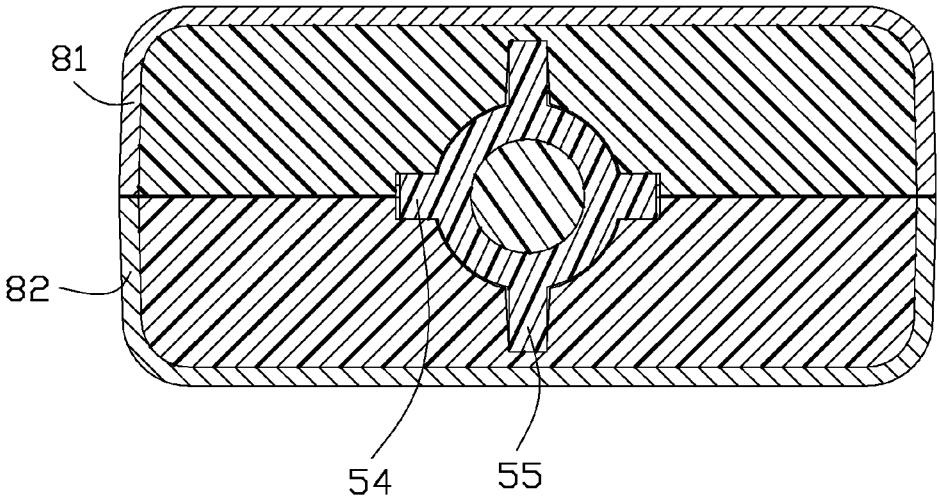
FIG. 6 is a cross-sectional view of the cable assembly taken along line 6-6 of FIG. 1.

Referring to FIGS. 1-3, a cable connector assembly 100 in accordance with the present invention comprises an insulative housing 1, a plurality of contacts 2 received in the housing 1, a printed circuit board 3, a metallic shielding 4 enclosing a mating port 11 of the insulative housing 1, a cable 5, a metallic shell 6 enclosing the printed circuit board 3 and partially of the housing 1 and the cable 5 and a cover 8 enclosing the aforementioned components. the cover 8 is made of insulative material, and comprises a upper cover 81 and a lower cover 82 assembled to each other along a direction perpendicular to a mating direction.

Referring to FIGS. 2-5, The contacts 2 are assembled in the insulative housing 1, and tail portions of the contacts 2 are bent downwards beyond the lower surface of the housing 1 and soldered to the printed circuit board 3.

Referring to FIGS. 1-3, the insulative housing 1 defines a pair of fastening holes (not shown) at opposite sides thereof, a pair of nuts 9 are mounted in the corresponding fastening holes to couple to a complementary connector (not shown). The metallic shielding 4 is enclosing the insulative housing 1 and a mating port of the cable connector assembly 100 to reduce Electro Magnetic Interference (EMI). The metallic shielding 4 defines a vertical wall with a pair of through holes (not shown) aligned with corresponding fastening holes along the mating direction.

The cable 5 defines a strain relief portion 50, the strain relief portion has a extruding portion 52 on a front end thereof and a rectangular retaining portion 51 behind the extruding portion 52, the retaining portion 51 is spaced apart from the protruding portion 52, and the retaining portion 51 has a larger width than the protruding portion 52 along a transverse direction. The strain relief portion 50 defines a circular hole 53, the middle between the extruding portion 52 and the retaining portion 51 defines four retaining blocks, two of the retaining blocks arranged on a left and a right sides of the circular hole 53 defines the first retaining blocks 54, the first retaining blocks 54 are jointed with the front surface of the retaining portion 51 but not jointed with the back surface of the extruding portion 52. The other two retaining blocks 54 arranged on an up and a down sides of the circular hole 53 defines the second retaining blocks 55, the second retaining blocks 55 are jointed with the front surface of the retaining portion 51 and jointed with the back surface of the extruding portion 52. The cable 5 also comprises a plurality of wires (not shown).

The metallic shell 6 is made of metallic material and comprises a top shell 61 and a bottom shell 62 assembled to each other. The top shell 61 comprises a base portion 610 and an extension portion 612 bending upwardly firstly and then extending forwardly from the base portion 610, a cable receiving portion 615 extending backwards from the base portion 610. The extension portion 612 is wider than the base portion 610 along the transverse direction. The top shell 61 defines a pair of the first side walls 613 bent downwardly, and the front end of the top shell 61 defines a front wall 614 bent downwardly. The middle portion of the front wall 614 defines a first through hole 6140 receiving the mating port 11 of the insulative housing 1. The front wall 614 defines a pair of second through holes 6141 at opposite of the first hole 6140 aligned with corresponding fastening holes along the mating direction.

The bottom shell 62 comprises a lower wall 621 and a pair of lateral walls 623 bent upwards from both sides of the lower wall 621. The lateral walls 623 are engaging with the corresponding side walls 613 of the top shell 61.

The cover 8 is made of insulative material and comprises a upper cover 81 and a lower cover 82 assembled to each other. The upper cover 81 defines a plurality of posts 811 around an inner wall thereof equably, the lower cover 82 defines a plurality of engaging holes 821 cooperating with corresponding posts 811. The upper cover 81 and the lower cover 82 have the same configuration with each other. Both of the upper cover 81 and the lower cover 82 define a clipping portion 813, 823 and a groove 814, 824 extending forward from the back surface of the cover 8. The clipping portion 813, 823 has clipping surface 8130, 8230. A first arc-shaped cutout 8131, 8231 formed in the surface of the clipping surface 8130,8230. A second cutout 815,825 formed in the lower surface of the groove 814,824, the first cutout 8131,8231 spart from the second cutout 814,824 and parallel to each other. In the back view of the connector, a left end and a right end sides of the second cutout 815 disposed above the lower surface of the lateral walls of the upper cover 81, the lower surface of the groove 814 defines a pair of first gaps 8150, the gaps 8150 spart from each other and closing to the end of the second arc-shaped cutout 815. The middle of the second arc-shaped cutout 815 defines a second gap 8151 extending along the lower surface of the groove 814. In accord with the upper cover 81, the lower surface 82 also defines a pair of third gaps 8250 and a forth gap 8251. The configuration of the third gap 8250 is similar to the first gap 8150, the configuration of the forth gap 8251 is a similar to the second gap 8151, and detailed description is omitted here.

In assembly, the contacts 2 are received in the insulative housing 1 and tails portion of the contacts 2 are soldered to a front of the printed circuit board 3. The metallic shielding 4 enclosing the insulative housing 1. The aforementioned elements are assembled into the bottom shell 62, and then the top shell 61 is assembled to the bottom shell 62 along an up-to-down direction, the side walls 613 of the top shell 61 are engaging with the lateral walls 623 of the bottom shell 62 to combine the top shell 61 and the bottom shell 62. The extension portion 612 of the top shell 61 is shielding a rear section of the insulative housing 1, and the base portion 610 is located above the printed circular board 4. Therefore, the shell 6 is enclosing the shielding member 4, the housing 1 and the electrical connection area to reduce EMI.

Then the cover 8 is assembled to the aforementioned elements, the retaining portion 51 of the cable 5 is disposed in the groove 824 of the lower cover 82 to prevent the cable 5 moving forth, the protruding portion 52 of the cable 5 is located in the middle of the first arc-shaped cutout 8231 and the second arc-shaped cutout 825 and put the lower second retaining blocks locked in the forth gap 8251. A left and a right sides of the first retaining blocks 54 locked in the third gap 8250, then the upper cover 81 is assembled to the lower cover 82 along the up-to-down direction, the posts 811 of the upper cover 81 are inserted into the corresponding engaging holes 821 of the lower cover 82, and the clipping portions 813 of the upper cover 81 and the clipping portions 823 of the lower cover 82 are cooperated with each other to retain the cable 5. The upper of the second retaining blocks 55 locked in the second gap 8151 of the upper cover 81, the spare portion of the left and the right sides of the second retaining blocks 55 locked in the third gap 8250 are mounted in the first gap 8150. Thus, the cable connector assembly 100 is assembled.

In the above embodiment, according to put the first and the second retaining blocks 54,55 between the extruding portion 52 and the retaining portion 51, and at the same time the clipping portion 813,823 defines gaps cooperating with the first and the second retaining blocks to lock the strain relief portion 50 in the cover 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received therein;

a cable connected with the contacts;

a strain relief portion molded on the cable, the strain relief having an extruding portion on the front end thereof and a retaining portion behind the extruding portion, a plurality of retaining blocks arranged between the extruding portion and the retaining portion;

a cover enclosing the housing, the cable and the strain relief, the cover comprising an upper cover and a lower cover, a back surface of the upper cover and the lower cover defining a arc-shaped cutout, the retaining portion is mounted in the front of the arc-shaped cutout and the retaining block is locked in the arc-shaped cutout wherein the strain relief portion comprises a circular hole through the extruding portion and the retaining portion along the front-to-back direction, and the retaining blocks are defined around the circular hole; there are four retaining blocks and two of the retaining blocks arranged at a left and a right side of the circular hole define first retaining blocks; wherein the other two retaining blocks arranged on an up and a down side of the circular hole define second retaining blocks, wherein the first retaining blocks are jointed with the front surface of the retaining portion but not jointed with the back surface of the extruding portion.

2. The cable connector assembly as claimed in claim 1, wherein the second retaining blocks are jointed with the front surface of the retaining portion and jointed with the back surface of the extruding portion.

3. The cable connector assembly as claimed in claim 1, wherein the left end and the right end sides of the arc-shaped cutouts of the upper cover disposed above the lower surface of the lateral walls of the upper cover.

4. The cable connector assembly as claimed in claim 3, wherein the back wall of the upper cover defines a first gap nearby the left end and right end of the arc-shaped cutout for locking the first half of the first retaining block.

5. The cable connector assembly as claimed in claim 4, wherein the middle of the second arc-shaped cutout defines a second gap extending along the back wall of the upper cover for locking the first half of the second retaining block.

6. The cable connector assembly as claimed in claim 5, wherein the back wall of the lower cover defines a first gap for locking the lower half of the first retaining block.

7. The cable connector assembly as claimed in claim 6, wherein the back wall of the lower cover defines a second gap for locking the lower half of the second retaining block.

8. The cable connector assembly as claimed in claim 7, wherein the cable connector assembly also comprises a metallic shell enclosing the rear section of the insulative housing.

9. A cable connector assembly comprising:

a cover defining a receiving space and a rear wall behind the receiving space;

an insulative housing received in the receiving space and defining a mating port forwardly extending beyond the receiving space to communicate with an exterior;

a plurality of contacts disposed in the housing;

a cable connected on a rear side of the housing; and a strain relief surrounding a portion of the cable around the rear wall, said strain relief defining an enlarged extruding portion and retaining portion respectively located intimately in front of and behind the rear wall to cooperate with each other for sandwiching the rear wall therebetween in a front-to-back direction; wherein the rear wall defines an opening for passage of the cable, and said opening is not circular but including some radially extending slots so as to snugly receive a corresponding portion of the cable which is located between the extruding portion and the retaining portion of the cable under condition that said corresponding portion of the cable defines a complementary cross-section with regard to the opening for preventing any relative rotation therebetween, wherein the cover defines a clipping portion into which the extruding portion is received.

10. The cable connector assembly as claimed in claim 9, wherein said cover is composed of two halves, and the opening is formed by said two halves under condition that said radially extending slots are formed by both said two halves instead of one.

11. The cable connector assembly as claimed in claim 9 wherein said cable is connected to a printed circuit board which is located at the rear side of the housing and connected to the contacts.

* * * * *